US005191741A

United States Patent [19]

Jones

[11] Patent Number: 5,191,741

[45] Date of Patent: Mar. 9, 1993

[54] FLUIDIZED BED BOTTLE FILLING SYSTEM

[75] Inventor: Jay J. Jones, Willow Grove, Pa.

[73] Assignee: McNeil-PPC, Inc., Milltown, N.J.

[21] Appl. No.: 735,482

[22] Filed: Jul. 25, 1991

[51] Int. Cl.[5] ..... B65B 1/30; B65B 35/48; B65B 37/16

[52] U.S. Cl. ..... 53/475; 53/244; 53/900; 198/380

[58] Field of Search ..... 53/900, 473, 443, 537, 53/500, 244, 475; 209/591; 198/380, 428

[56] References Cited

U.S. PATENT DOCUMENTS

| | | | |
|---|---|---|---|
| 3,139,713 | 7/1964 | Merrill et al. | 53/55 |
| 3,241,286 | 3/1966 | Dearsley | 53/475 |
| 3,756,402 | 9/1973 | Wagers, Jr. et al. | 209/73 |
| 3,920,541 | 11/1975 | VandenBerg et al. | 209/74 R |
| 3,925,960 | 12/1975 | Saari et al. | 53/240 X |
| 3,969,227 | 7/1976 | Garris | 209/73 |
| 4,185,734 | 1/1980 | Bross | 198/484 |
| 4,221,297 | 9/1980 | Aranda Lopez et al. | 209/576 |
| 4,241,293 | 12/1980 | Bross | 198/503 X |
| 4,341,244 | 7/1982 | Facchini | 141/18 |
| 4,389,064 | 6/1983 | Laverriere | 294/64 R |
| 4,535,006 | 8/1985 | Naunapper et al. | 427/213 |
| 4,674,259 | 6/1987 | Hills | 53/202 |
| 4,680,464 | 7/1987 | Bross | 53/57 X |

FOREIGN PATENT DOCUMENTS

| | | | |
|---|---|---|---|
| 2-4601 | 1/1990 | Japan | 53/900 |

*Primary Examiner*—James F. Coan

[57] ABSTRACT

Methods and apparatus for counting tablets and feeding a predetermined number of tablets to a bottle are disclosed. The present invention creates a fluidized bed of tablets above a plurality of slat bars, each of which comprises a plurality of cavities having a vacuum port connected to a source of negative pressure. The vacuum draws individual tablets down from the fluidized bed and into the cavities in the slat bar, thereby ensuring efficient and complete filling of each cavity with a tablet. Upon exit from the fluidized bed, the vacuum flow is disconnected and, in certain embodiments, a positive airflow may be flowed through the vacuum ports to eject the tablets into means for feeding the tablets into bottles.

15 Claims, 3 Drawing Sheets

FLUIDIZED BED BOTTLE FILLING SYSTEM

The present invention relates to methods and apparatus for filling containers with a predetermined number of items. More specifically, the present invention relates to the creation of a fluidized bed of tablets over a continuous slat feeder for filling bottles.

BACKGROUND OF THE INVENTION

The high volume demanded by the pharmaceutical market has placed great pressures upon the manufacturing arts related to making tablets and dispensing them into containers. For purposes herein, the term "tablet" will refer to any of the numerous compressed tablet, gelatin capsule or other solid dose forms of oral drugs, both prescription and non-prescription, as well as analgesics, vitamins and other products dispensed in tablet or capsule form. After a quantity of tablets has been manufactured, they are usually stored or shipped in a bulk container. The present invention relates to methods and apparatus for transferring tablets from bulk into smaller containers such as bottles. Typically, these containers will be those provided directly to the end user, however, in some instances the container or bottle will be for intermediate storage, e.g., for use in a hospital or pharmacy.

Individual bottles may be filled with tablets using a device known as a continuous slat counter. Such devices typically comprise a moving bed made up of a series of grooved slats which passes beneath a quantity of tablets. The grooves are further subdivided into cavities and one tablet is permitted to drop into each cavity until all the cavities are filled. After the filled slats move from beneath the stationary quantity of tablets they are inverted, the tablets fall out and are collated and fed into each bottle via transport through a manifold system.

For example, U.S. Pat. Nos. 3,139,713; 4,185,734; 4,241,293; and 4,680,464, all of which are assigned to Pennwalt Corporation of Philadelphia, Pa., disclose an article counting machine for filling bottles that uses a stationary quantity of tablets disposed above a moving bed of slats. These patents recognize that these machines can miscount articles when a tablet is wedged in a cavity or when a cavity is empty. In this regard, U.S. Pat. No. 4,241,293 discloses an ejector blade that protrudes from the base of the cavity and ejects tablets wedged in the cavity. U.S. Pat. Nos. 4,185,734 and 4,680,464 both disclose optical scanners for detecting the presence or absence of a tablet from a particular cavity.

Another version of a continuous slat article counting and filling machine is disclosed in U.S. Pat. No. 3,925,960, assigned to the Lasko Company of Fitchburg, Mass. In this system, the slats and cavities are oriented horizontally, i.e., coaxial with the axis around which they are moving. A series of chutes collects the counted tablets and delivers them to a moving series of containers. Another, more recent variation of slat counting machines is disclosed in U.S. Pat. No. 4,674,259, assigned to Package Machinery Co. of Longmeadow, Mass. This machine uses vertically-oriented set of slats with cavities that deliver the counted product to a series of chutes that shuttle alternately between a first and a second row of containers.

In all of the above-described continuous slat counter bottle filling systems, the tablets are directed into the cavities in the slat by the force of gravity. However, mechanical vibrations have been imparted to the slats and to the stationary quantity of tablets over the continuously moving bed of slats to assist the tablets in falling into the cavities.

In any event, if the slats are positioned beneath the stationary quantity of tablets for a sufficiently long period of time, every cavity will eventually be filled. However, since the slats are continuously moving beneath the quantity of product, the amount of time a given slat spends beneath the product will be directly related to the speed of the slats' movement. Therefore, if the speed of the slats is increased, the time beneath the quantity of product may not be sufficient to ensure that all the cavities are filled. As a result, a severe limitation within most slat counter bottle filling systems in that the speed at which the slats move beneath the quantity of tablets cannot exceed a certain level. If the speed is increased above this level the number of empty cavities quickly rises, resulting in underfilled bottles.

The probability of tablets filling the slat cavities also depends upon the shape of the tablet. The easiest tablet to handle would be a spherically shaped tablet. As a tablet's dimensions change to become thinner or longer or irregularly shaped, the time required for a tablet to fill the empty cavities increases. With irregularly shaped tablets, it may take such a long time to fill the cavities that the operating speeds of state of the art tablet bottle fillers will be extremely slow. To solve this problem, one method the state of the art filler manufacturers use is to enlarge the cavities to allow the tablets to fall into the cavities quicker. The drawback to this approach is that as the cavities become oversized, the frequency of wedging and getting two tablets within one cavity will become a problem.

It would therefore be desirable to be able to increase the speed at which slat counter bottle filling machines operate. It is further desirable to ensure that every cavity of a slat is filled with a tablet. Accordingly, it is an object of the present invention to increase the speed of a slat counter bottle filler without sacrificing filling and counting accuracy.

SUMMARY OF THE INVENTION

These and other objectives of the present invention are met by providing a slat counter bottle filling machine that creates a fluidized bed of tablets above the slats. The present invention provides a novel slat bar which cooperates with the fluidized bed of tablets to ensure that each cavity is filled by creating a vacuum within each cavity.

Accordingly, the present invention provides apparatus for counting a predetermined number of tablets and transferring the number of tablets to a means for filling bottles. In a preferred embodiment the apparatus comprises a tablet bin for retaining a plurality of tablets and a plurality of connected slat bars each having a predetermined number of cavities.

The slat bars are disposed beneath the tablet bin and are adapted to move across the bottom of the tablet bin. In accordance with the present invention, a fluidizing airflow is created within the tablet bin sufficient to cause the tablets to exhibit the characteristics of a fluidized bed. A vacuum airflow is created within the cavities to provide a negative pressure. The vacuum airflow can be selectively disconnected from the cavities when the tablets need to be ejected. Thus, in operation the slat bars move beneath the tablet bin and the cavities are filled with tablets. After the slat bars exit from beneath the tablet bin the vacuum airflow is disconnected and the tablets may be transferred to a means for filling bottles.

In certain preferred embodiments, the slat bars comprise a plurality of airflow orifices and the fluidizing airflow is directed through these orifices into the bed of tablets. Also, in certain preferred embodiments the vacuum airflow means comprises one or more vacuum manifolds connected to a vacuum manifold tube which is in turn connected to a plurality of vacuum ports disposed within each of the cavities in the slat bars. In certain preferred embodiments, these same vacuum airflow manifolds and ports are used to permit an ejection airflow to be selectively directed into the cavities to eject the tablets retained within the cavities when desired.

Thus, the present invention provides an improved slat bar for use in a continuous slat feeder and counter for counting tablets which comprises a plurality of cavities arranged to accept a predetermined number of tablets and the vacuum orifice disposed within each of the cavities for connection to a source of airflow. In certain embodiments, the slat bar further comprises a plurality of airflow orifices for permitting a fluidizing airflow to flow through the slat bar.

The present invention also discloses methods of counting a predetermined number of tablets and transferring the number of tablets to a means for filling bottles comprising the steps of providing a quantity of tablets disposed in a tablet bin and providing a plurality of slat bars wherein the slat bars comprise a predetermined number of a plurality of cavities and are arranged to move beneath the tablet bin. In accordance with the methods of the present invention, air is then flowed into the tablet bin in an amount sufficient to cause the quantity of tablets to exhibit the properties of a fluidized bed, and a negative pressure is created in the cavities. By moving the slat bars beneath the tablet bin from an entry location to an exit location, the predetermined number of cavities in the slat bars are filled with a corresponding predetermined number of tablets. After the slat bars have exited from beneath the tablet bin the source of negative pressure is removed and the tablets are transferred from the slat bar to a means for filling bottles.

In certain preferred embodiments, the methods of the present invention further comprise flowing air through the ports in the cavities after the source of negative air pressure has been removed thereby creating a positive pressure and airflow to eject the tablets from the cavities. In other preferred embodiments, the airflow used to create the fluidized bed is flowed through a plurality of airflow orifices in the slat bars.

The apparatus of the invention which combines a fluidized bed and the introduction of a negative or vacuum pressure in the tablet and methods of the invention are particularly suited for filling irregularly shaped tablets into bottles and containers. The combination as claimed causes a gentle "pulling" action of the tablets into the cavities. This positive "pulling" action eliminates the aforementioned needs of slowing the filler process or having to enlarge the cavities. The present invention thus provides a means to provide high speed and accurate filling while minimizing possible wedging of irregularly shaped tablets.

DETAILED DESCRIPTION OF THE PREFERRED EMBODIMENTS

Figure 1:
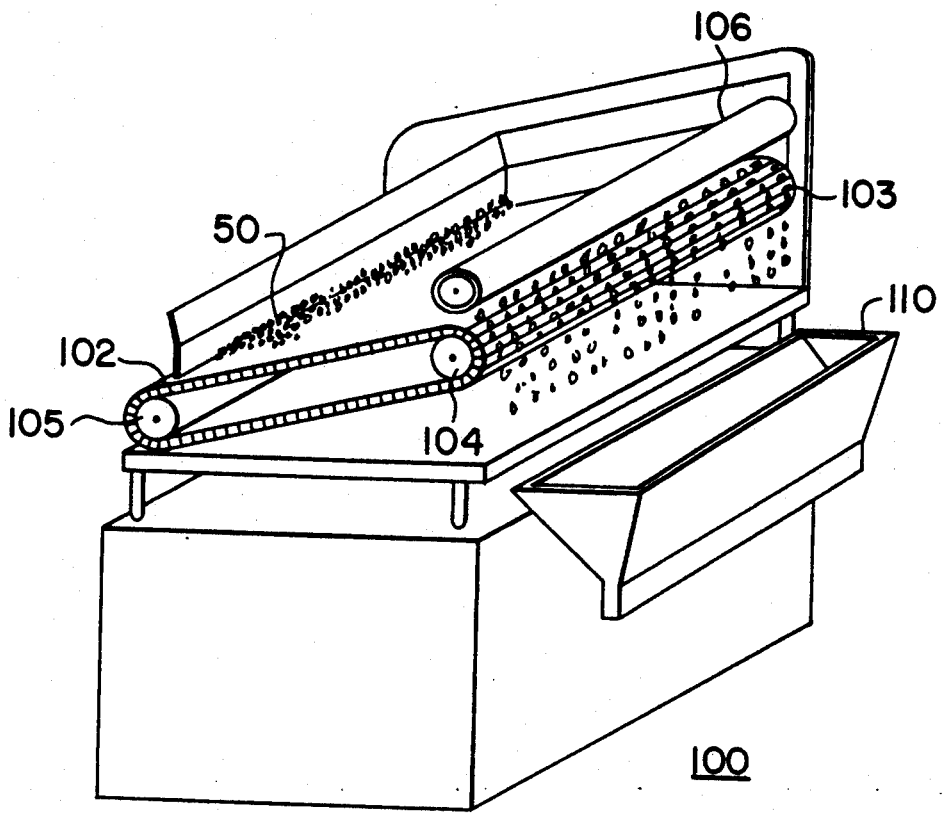
FIG.1 PRIOR ART
FIG. 1 is a perspective view of a continuous slat feeder as known in the art.

Referring to FIG. 1, a perspective view of a conventional slat feeder 100 is shown. For purposes of illustration, one side wall and other portions of the apparatus have been removed. Those of ordinary skill will be familiar with the overall appearance and operation of such conventional slat feeders. A view of such conventional equipment and ancillary equipment is illustrated, for example, in FIG. 1 of U.S. Pat. No. 3,925,960 to Saari et al., discussed above, the entire disclosure of which is incorporated herein by reference.

In a conventional slat feeder 100, a quantity of tablets 50 are disposed atop a moving bed of interconnected slats 102. As explained above, each slat 102 is provided with a plurality of cavities or recesses of an appropriate size to accept one of the tablets. As the slats move beneath the tablets 50, gravity and the motion of the slat 102 will result in each cavity being filled if sufficient time is permitted. As also explained above, certain conventional slat feeders 100 have attempted to facilitate the filling of the cavities by introducing mechanical vibration into the slats 102. Since the tablets are randomly moved about by such vibrations, the slats 102 are somewhat more easily filled and some increase in the speed at which the slats 102 move can be realized.

As shown by the arrows in FIG. 1, the continuous bed of slats 102 moves along a path describing an endless loop, in the manner of a conveyor belt, carried by upper roller 104 and lower roller 105. Upon reaching the upper end 103 of the slat bed, the relative orientation of the slats changes to follow the contour of the upper roller 104 supporting them. As each slat 102 passes over the upper roller 104 the change in orientation permits the tablets 50 within the cavities to fall out of the cavities and into counting and bottle filling apparatus 110. A brush roller 106 disposed above the slat bed in the vicinity of the upper roller 104 prevents tablets 50 not retained in the cavities from continuing to travel with the slat 102. As explained above, it has been recognized that in certain instances a tablet will become lodged within a cavity. For this reason, conventional slat feeders 100 therefore sometimes require the provision of a separate ejector to force the tablets 50 from the cavities of the slats 102.

Figure 2:
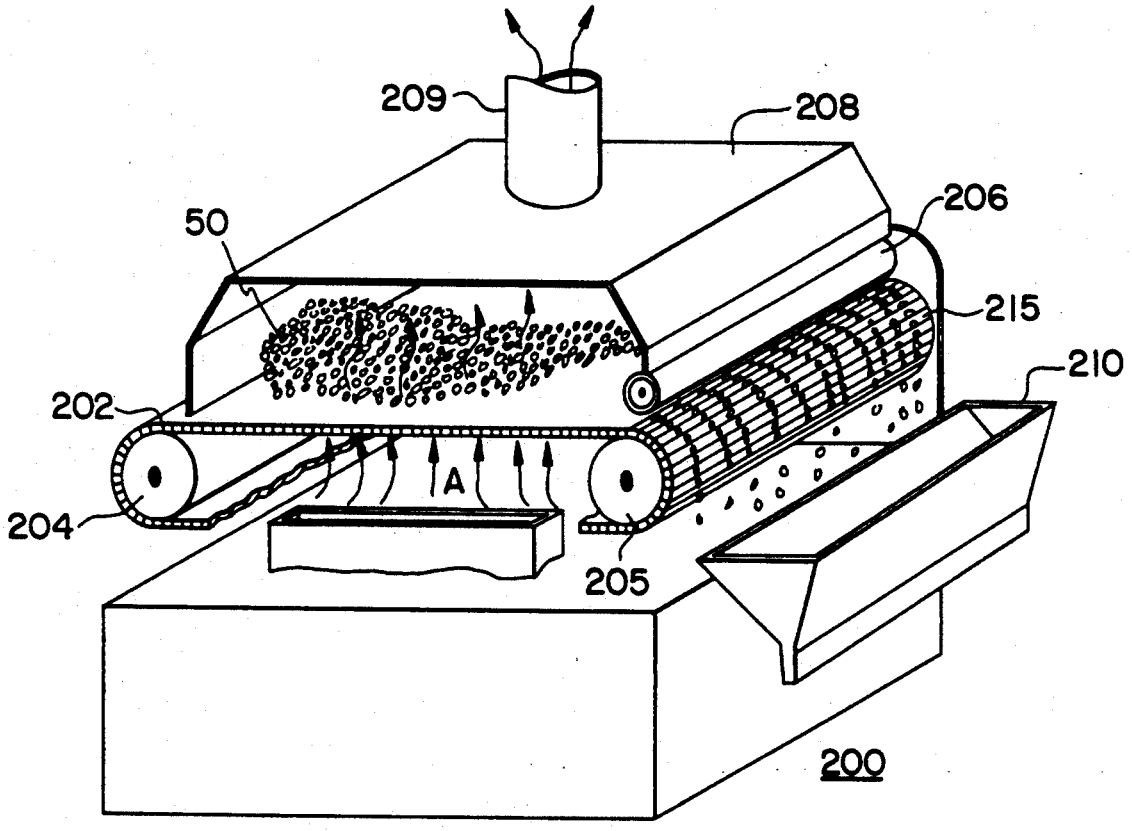
FIG. 2 is a perspective view of a fluidized bed continuous slat feeder made in accordance with the present invention.

Turning now to FIG. 2, there is shown a perspective view of a slat feeder 200 made in accordance with the present invention. A series of slats 202 are preferably connected together to form a continuous moving bed supported by a first support roller 204 and an exit support roller 205. Either or both of the rollers 204, 205 may be driven by a power source or an independent power source may provide the means for moving the continuous slat bed around the rollers 204, 205 as a continuous loop. It has now been found that by creating a cushion of air below the quantity of tablets 50, the tablets 50 will exhibit the properties of a fluidized bed and as such individual tablets will constantly randomly re-orient themselves suspended just above the surface of the slat bars 202. As explained in further detail below, a vacuum is most preferably created in each cavity in the slat bars 202 to pull down a tablet from the fluidized bed into the cavity and secure it therein. As illustrated in FIG. 2, fluidizing airflow A preferably flows through the bottom of the bed of slats 202. The duct work and other equipment related to creating such an airflow are not illustrated. The design and operation of such equipment will depend upon numerous factors including the design of the slat 202, the type and amount of tablets 50 and the overall size of the slat feeder 200, as well as other factors well known to those of ordinary skill. The considerations of air flow velocity, pressure and bed design are known in the art. Fluidized beds of tablets have been created for other purposes such as applying coatings, as disclosed in U.S. Pat. No. 4,535,006 to Naunapper et al.

A further benefit of creating a fluidized bed of tablets 50 is that any dust or loose particulate matter mixed in with the tablets can be removed. As illustrated, the fluidized bed of tablets 50 is preferably retained beneath a tablet bin 208, shown with one side wall removed for purposes of illustration. Preferably, a brush roller 206 is disposed between the tablet bin 208 and the surface of the bed of slats 202 to keep the tablets 50 beneath the tablet bin 208. After the airflow A has passed through the fluidized bed of tablets 50 it passes out of the tablet bin 208 through a dedusting duct 209. The exit airflow from the dedusting duct 209 is then exhausted to filters, particle traps or other ancillary environmental conditioning apparatus not illustrated.

In accordance with one aspect of certain embodiments of the present invention, airflow is also directed to an ejection section 215 where the vacuum (i.e., negative air flow) holding the tablets 50 in the cavities is removed and a positive flow pressurized air is flowed into the cavities to force the tablets 50 out. Of course, as in the system described with reference to FIG. 1, most tablets 50 will fall freely from the cavities due to the force of gravity alone. The air blast ejection feature of the present invention is useful to ensure full ejection of all tablets from each slat 202. The ejection airflow used to effect ejection may either be diverted from the fluidizing airflow A or may be delivered from another source if different conditions of pressure and velocity are required.

Figure 3:
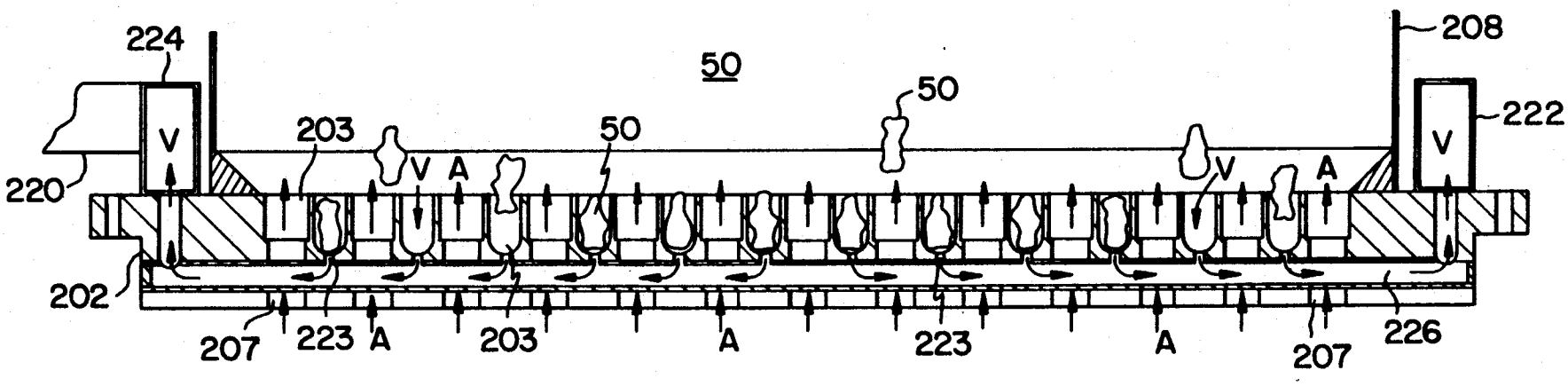
FIG. 3 is a cross-sectional elevation view of the fluidized slat bar of the present invention.

A cross-sectional view of a slat 202 made in accordance with the present invention is illustrated in FIG. 3. For purposes of illustration, only a few of the plurality of tablet 50 held as a fluidized bed within the tablet bin 208 are illustrated. A shown by the arrows, fluidizing slat airflow A is most preferably introduced into the tablet bin 208 through a plurality of orifices 207 across the slat bar 202. As mentioned above, the shape, size and placement of the orifices 207 that admit the fluidizing airflow A will depend upon the specific application. Also visible in this view is the vacuum airflow V that is created within the cavities 203 of the slat bar 202. The vacuum airflow V is created by a vacuum source 220. As illustrated, the vacuum source 220 most preferably comprises vacuum manifolds 222, 224 disposed at either end of the slat bars 202 to create an even pull of negative pressure. The vacuum airflow V is transferred to the cavities 203 via vacuum manifold tube 226 in order to prevent the vacuum flow V from being affected by the fluidizing air flow A. The vacuum manifold tube 226 is connected to the base of each cavity via vacuum ports 223. In essence, y applying a vacuum as shown, a negative pressure is created at the base of each cavity 203.

Referring still to FIG. 3, it should be noted that the tablets 50 are illustrated as being irregularly shaped, however, those of ordinary skill will realize that the present invention may be used with nearly any size and shape tablet 50. The situation illustrated in FIG. 3 represents the condition of a slat bar 202 that is beneath the table bin 208. A number of the cavities 203 have been filled; however, certain cavities 203 remain open. An advantage of the vacuum system 220 shown is that as the cavities 203 are filled with tablets 50, the vacuum flow V through each vacuum port 223 that connects the cavity 203 to the vacuum manifold 226 is at least partially blocked. Since the level of vacuum flow v is preferably substantially constant, as the vacuum ports 223 are blocked by tablets 50, the localized level of vacuum flow at the remaining unblocked vacuum ports 223 increases and concomitantly increases the likelihood that a properly oriented tablet 50 will be drawn into the still-open cavity 203. Once all cavities have been filled, the vacuum flow V will have been substantially reduced across the length of the filled slat bar 202 and no further tablets 50 will be drawn down from the fluidized bed into that particular slat bar 202.

Referring again to FIG. 2, after a filled slat bar 202 passes beneath the brush roller 206 and emerges from beneath the tablet bin 208, the fluidizing airflow A no longer flows through the slat bar 202. At this point, the vacuum flow V is also preferably cut off, leaving the tablets 50 retained inside the cavities 203 due to the force of gravity alone. At another point along its path around the exit support roller 205 the vacuum flow system 220 of the slat bars 202 is reconnected to a source of ejector air flow (not shown) that provides an outward blast of air to dislodge the tablets 50 from within the cavities 203. This ejection air stream may be diverted from the main fluidizing air stream A or may emanate from a separate source. After the tablets 50 have been ejected they fall into a bin or series of bins that form a manifold 210 comprised of bins or hoppers and filling tubes for directing the counted tablets into the bottles. The design and operation of such manifolds 210 are well known to those of ordinary skill.

The present invention also discloses novel methods for counting tablets and feeding the counted tablets into bottles. In a preferred embodiment, the methods of the present invention comprise providing a quantity of tablets disposed over a plurality of slats each having one or more cavities therein, and moving the slats beneath the tablets while forcing a quantity of air into the tablets to create a fluidized bed. Preferably, by creating a negative pressure in each cavity, a tablet is drawn from the fluidized bed into the cavity, at least partially blocking the vacuum airflow that created the negative pressure. After the slats emerge from beneath the fluidized bed, the vacuum airflow is disconnected and an ejector airflow is connected to the slats, creating an ejector airstream that ejects the tablets into a manifold system that deposits the tablets into bottles.

The present invention therefore presents a system which provides several benefits over those of the prior art. The air flow pattern created by the slat bar 202 of the preferred embodiments present invention ensures that each cavity 203 is filled. Additionally, the cavities 203 are filled more quickly than was previously possible, due to the active measures taken to pull the tablets 50 into the cavities. As a result, the bed of slat bars 202 can be moved beneath the tablet bin 208 faster to provide a higher rate of bottle filling than possible with prior art systems particularly when applied to irregularly shaped tablets such as vitamin character tablets.

The unique fluidized bed approach disclosed herein also provides several benefits. First, the fluidization creates a gentle, cushioned mass of tablets which creates far less damage to the tablets than the mechanical vibrations used in the prior art. In particular, it has been noted that chewable uncoated tablets tend to degrade when counted and fed using the prior art systems, whereas this problem minimized by the gentler handling of the fluidized bed of the present invention. An additional benefit of the fluidized bed system is that the tablets are dedusted. In conventional feeders, dust is permitted to enter the bottle.

Those of ordinary skill will realize that although certain embodiments of the present invention have been illustrated and described above with particularity, these embodiments are meant to be illustrative and do not limit the present invention. For one example, the fluidizing airflow A does not have to be created by an airflow passing directly through orifices 207 within the slat bar 202 itself. Those of ordinary skill will realize that this and numerous other modifications and adaptations of the fluidized bed and slat system disclosed are possible. Therefore, reference should be made to the appended claims and their equivalents to determine the scope of the invention.

What is claimed is:

1. Apparatus for counting a predetermined number of tablets and transferring the number of tablets to a means for filling bottles, the apparatus comprising:

a tablet bin for retaining a plurality of tablets the tablet bin having a vertical dimension and a lateral dimension;

a plurality of connected slat bars comprising a predetermined number of cavities and a plurality of orifices, the slat bars disposed beneath the tablet bin and adapted to move across the lateral dimension of the tablet bin the orifices being provided in sufficient size and placement for creating an airflow within the tablet bin sufficient to cause a plurality of tablets to exhibit the characteristics of a fluidized bed;

a vacuum airflow means for creating a negative pressure within each of the cavities; and means for selectively disconnecting the vacuum airflow means from the cavities;

whereby as the slat bars move beneath the tablet bin the cavities are filled with tablets and after exit from beneath the tablet bin the tablets are transferred to a means for filling bottles.

2. The apparatus of claim 1, wherein the slat bar means are connected to form a continuous bed and are supported by a first support roller means and an exit roller means.

3. The apparatus of claim 1, wherein the tablet bin further comprises a dedusting duct for removing the fluidizing airflow after it has migrated through the plurality of tablets.

4. The apparatus of claim 1, further comprising a brush roller disposed near the point of the tablet bin at which the slat bars exit.

5. The apparatus of claim 1, wherein the slat bars further comprise a plurality of airflow orifices and the fluidizing airflow is directed through the orifices into the plurality of tablets.

6. The apparatus of claim 1, wherein the vacuum airflow means comprises one or more vacuum manifolds connected to a vacuum manifold tube, the vacuum manifold tube being connected to a plurality of vacuum ports disposed within each of the cavities in the slat bars.

7. The apparatus of claim 1, further comprising ejector means for creating an ejector airflow comprising means for selectively connecting an airflow to the vacuum airflow means to create a positive pressure within each of the cavities, thereby ejecting the tablets within the cavities.

8. The apparatus of claim 1 which is particularly suited for irregularly shaped tablets.

9. A slat bar for a continuous slat feeder and counter for counting tablets and transferring tablets into bottles comprising:

a plurality of cavities arranged to accept a predetermined number of tablets;

a vacuum port disposed within each of the cavities for connection to a source of airflow and a plurality of orifices provided in sufficient size and placement for creating an airflow suitable for fluidizing tablets.

10. The apparatus of claim 9 which is particularly suited for irregularly shaped tablets.

11. A method of counting a predetermined number of tablets and transferring the number of tablets to a means for filling bottles comprising the steps of:

providing a quantity of tablets disposed in a tablet bin;

providing a plurality of slat bars arranged to move beneath the tablet bin, the plurality of slat bars comprising a predetermined number of a of cavities and a plurality of orifices, the orifices being provided in sufficient size and placement for flowing air through to fluidize said tablets;

flowing air through said orifices into the tablet bin sufficient to cause the quantity of tablets to exhibit the properties of a fluidized bed;

creating a negative pressure in each of the cavities;

moving the slat bars beneath the tablet bin from an entry location to an exit location;

filling each of the predetermined number of cavities with tablets;

removing the source of negative pressure after the slat bar has passed the exit location; and transferring the quantity of tablets corresponding to the predetermined number of filled cavities from the slats bar to the means for filling bottles.

12. The method of claim 11 wherein the pills are irregularly shaped.

13. The method of claim 12 further comprising the step of: conducting air through the tablet bin into a dedusting duct.

14. The method of claim 12, further comprising the step of: flowing air through the ports in the cavities after the source of negative air pressure has been removed to create a positive pressure and airflow, whereby the tablets are ejected from the cavities.

15. The method of claim 14 wherein the pills are irregularly shaped.

* * * * *